US007235010B2

(12) United States Patent
Baerlocher

(10) Patent No.: US 7,235,010 B2
(45) **Date of Patent: *Jun. 26, 2007**

(54) GAMING DEVICE HAVING IMPROVED OFFER AND ACCEPTANCE BONUS SCHEME

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 115 days.

This patent is subject to a terminal disclaimer.

(21) Appl. No.: 11/112,566

(22) Filed: Apr. 22, 2005

(65) Prior Publication Data

US 2005/0187010 A1 Aug. 25, 2005

Related U.S. Application Data

(63) Continuation of application No. 10/074,273, filed on Feb. 12, 2002, now Pat. No. 6,899,623, and a continuation of application No. 09/680,630, filed on Oct. 6, 2000, now Pat. No. 6,375,187.

(51) Int. Cl.
*A63F 9/24* (2006.01)

(52) U.S. Cl. ..... 463/20; 463/16; 463/25; 273/143 R

(58) Field of Classification Search ..... None
See application file for complete search history.

(56) References Cited

U.S. PATENT DOCUMENTS 4,448,419 A 5/1984 Telnaes
4,582,324 A 4/1986 Koza et al.
4,991,848 A 2/1991 Greenwood et al.
5,178,390 A 1/1993 Okada
5,205,555 A 4/1993 Hamano
5,456,465 A 10/1995 Durham
5,524,888 A 6/1996 Heidel
5,536,016 A 7/1996 Thompson
5,542,669 A 8/1996 Charron et al.
5,560,603 A 10/1996 Seelig et al.
5,611,535 A 3/1997 Tiberio
5,711,525 A 1/1998 Breeding
5,769,716 A 6/1998 Saffari et al.
5,772,509 A 6/1998 Weiss (Continued)

FOREIGN PATENT DOCUMENTS

EP 0874337 A1 10/1998

(Continued)

OTHER PUBLICATIONS

Addams Family Advertisement and Article written by IGT, Strictly Slots, published in 2000.

(Continued)

*Primary Examiner*—Mark Sager
(74) *Attorney, Agent, or Firm*—Bell, Boyd & Lloyd LLP

(57) ABSTRACT

A gaming device having an improved offer and acceptance bonus scheme wherein the player has an opportunity to determine the number of offers the player may obtain during the bonus round and after the gaming device selects one of the possible award offers to the player the gaming device prevents that offer from being made to the player again.

44 Claims, 5 Drawing Sheets

U.S. PATENT DOCUMENTS 5,775,692 A 7/1998 Watts et al.
5,788,573 A 8/1998 Baerlocher et al.
5,823,874 A 10/1998 Adams
5,833,538 A 11/1998 Weiss
5,848,932 A 12/1998 Adams
5,851,148 A 12/1998 Brune et al.
5,873,781 A 2/1999 Keane
5,882,261 A 3/1999 Adams
5,902,184 A 5/1999 Bennett et al.
5,911,418 A 6/1999 Adams
5,947,820 A 9/1999 Morro et al.
5,951,397 A 9/1999 Dickinson
5,964,463 A 10/1999 Moore, Jr.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,019,369 A 2/2000 Nakagawa et al.
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,120,031 A 9/2000 Adams
6,126,541 A 10/2000 Fuchs
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,190,254 B1 2/2001 Bennett
6,190,255 B1 2/2001 Thomas et al.
6,213,876 B1 4/2001 Moore, Jr.
6,224,483 B1 5/2001 Mayeroff
6,231,442 B1 5/2001 Mayeroff
6,231,445 B1 5/2001 Acres
6,261,177 B1 7/2001 Bennett
6,302,790 B1 10/2001 Brossard
6,305,686 B1 10/2001 Perrie et al.
6,309,300 B1 10/2001 Glavich
6,328,649 B1 12/2001 Randall et al.
6,375,187 B1 4/2002 Baerlocher
6,494,785 B1 12/2002 Gerrard et al.
6,506,118 B1 1/2003 Baerlocher et al.
6,514,141 B1 2/2003 Kaminkow et al.
6,569,015 B1 5/2003 Baerlocher et al.
6,632,141 B2 10/2003 Webb et al.
6,648,754 B2 11/2003 Baerlocher et al.
6,692,355 B2 2/2004 Baerlocher et al.
6,719,632 B2 4/2004 Palmer et al.
6,722,981 B2 4/2004 Kaminkow et al.
6,722,982 B2 4/2004 Kaminkow et al.
6,726,563 B1 4/2004 Baerlocher et al.
6,776,711 B1 8/2004 Baerlocher et al.
6,786,820 B2 9/2004 Gerrard et al.
6,793,579 B2 9/2004 Baerlocher et al.
6,796,905 B2 9/2004 Baerlocher et al.
6,808,452 B2 10/2004 Baerlocher et al.
6,808,454 B2 10/2004 Gerrard et al.
6,811,483 B1 11/2004 Webb et al.
6,899,623 B2 5/2005 Baerlocher
6,966,833 B2 11/2005 Kaminkow et al.

FOREIGN PATENT DOCUMENTS

EP 0926645 A2 6/1999
EP 0944030 A2 9/1999
EP 0945837 A2 9/1999
EP 0981119 A2 2/2000
EP 0984408 A2 3/2000
WO WO 9732285 9/1997
WO WO 00/12186 3/2000

OTHER PUBLICATIONS

Adders and Ladders Advertisement written by Barcrest Ltd., published prior to 2000.
American Thunder Screen Shots written by IGT, published in 1998.
Big Bang Piggy Bankin Advertisement written by WMS Gaming, Inc., published prior to 2000.
Blackjack/Twenty-One Description written by Hoyle's Rules of Games, published in 1993.
Bonus Spin Red, White & Blue Advertisement written by IGT, published in 2000.
Bonus Times Article written by Strictly Slots, published in 2000.
By George written by IGT, published in 2002.
Caribbean Gold II Advertisement written by Aristocrat Incorporated,published in 1998.
Caribbean Gold II Advertisement, printed from www.laslots.com/aris on Jul. 29, 2004.
Cash Box Advertisement & Article written by Anchor Games, Strictly Slots, published in 2000.
Chutes & Ladders Game Instructions written by Hasbro-Milton Bradley, published in 1999.
Description of Let's Make a Deal Television Show written by letsmakeadeal.com (2 pages), printed on Mar. 16, 2001.
Double Diamond Game Descriptions written by IGT printed on Mar. 21, 2001.
Double Up Poker Game Description written by IGT Undated.
Easy Street Advertisements and Articles writtten by Casino Data Systems, published in 2000.
Elvis Advertisement written by IGT, published in 1999.
Empire Game Advertisement written by AC Coin, published in 1996.
Fire and Fortune Article written by Strictly Slots, published in 2001.
Fox "N" Hound Advertisement written by IGT, published in 2000.
In Between Game Description written by IGT, available prior to 2000.
Jackpot Party Advertisements and Articles written by WMS Gaming, Inc., published in 1998.
Keep Your Hat On Advertisement written by Aristocrat, published in 2001.
Let's Make a Deal written by geocities.com (10 pages), printed on Mar. 21, 2001.
Let's Make a Deal written by fortunecity.com (4 pages), printed on Mar. 21, 2001.
Let's Make a Deal written by Illinoislottery.com (1 pages), printed on Mar. 21, 2001.
Let's Make a Deal geocities.com (2 pages), printed on Mar. 16, 2001.
Let's Make a Deal Advertisement written by Shuffle Master and IGT, published in 2001.
Let's Make a Deal Advertisement written by Bally Gaming Systems, published in 1999.
Little Green Men Advertisement and Article written by IGT, Strictly Slots, published in 2000.
MegaJackpots Advertisement written by IGT, published in 1998.
Money Grab Article written by Strictly Slots, published in Apr. 2001.
Money in the Bank Advertisement written by Strictly Slots Konami, published in 2000.
Monopoly Advertisements and Articles written by WMS Gaming, Inc., Strictly Slots, published in 1998, 1999, 2000.

Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Article written by Strictly Slots, published in Mar. 2001.
Take Your Pick Advertisement written by IGT/Anchor Gaming, published in 1999.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Top Dollar Advertisement, published by IGT, 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.

GAMING DEVICE HAVING IMPROVED OFFER AND ACCEPTANCE BONUS SCHEME

PRIORITY CLAIM

This application is a continuation of and claims priority to U.S. patent application Ser. No. 10/074,273, filed Feb. 12, 2002, now U.S. Pat. No. 6,899,623, which is a continuation of and claims priority to U.S. patent application Ser. No. 09/680,630, filed Oct. 6, 2000, now U.S. Pat. No. 6,375,187, the entire contents of which are incorporated herein.

CROSS-REFERENCE TO RELATED APPLICATIONS

This application is related to the following commonly-owned patent applications: "GAMING DEVICE HAVING AN IMPROVED OFFER/ACCEPTANCE BONUS SCHEME," Ser. No. 09/966,884, "GAMING DEVICE HAVING OFFER/ACCEPTANCE ADVANCE THRESHOLD AND LIMIT BONUS SCHEME," Ser. No. 09/838,014, "GAMING DEVICE HAVING AN OFFER AND ACCEPTANCE SELECTION BONUS SCHEME WITH A TERMINATOR AND AN ANTI-TERMINATOR," Ser. No. 10/644,447, "GAMING DEVICE HAVING SEPARATELY CHANGEABLE VALUE AND MODIFIER BONUS SCHEME," Ser. No. 10/767,484, "GAMING DEVICE HAVING AN AWARD OFFER AND TERMINATION BONUS SCHEME," Ser. No. 10/810,146, "GAMING DEVICE HAVING VALUE SELECTION BONUS," Ser. No. 10/803,410, "GAMING DEVICE HAVING A BONUS ROUND WITH MULTIPLE RANDOM AWARD GENERATION AND MULTIPLE RETURN/RISK SCENARIOS," Ser. No. 10/865,713, "GAMING DEVICE HAVING OFFER/ACCEPTANCE ADVANCE THRESHOLD AND LIMIT BONUS SCHEME," Ser. No. 10/925,561, "GAMING DEVICE HAVING A DESTINATION PURSUIT BONUS SCHEME WITH ADVANCED AND SETBACK CONDITIONS," Ser. No. 10/920,518, "GAMING DEVICE HAVING IMPROVED AWARD OFFER BONUS SCHEME," Ser. No. 10/937,664, "GAMING DEVICE HAVING IMPROVED AWARD OFFER BONUS SCHEME," Ser. No. 10/952,062, and "GAMING DEVICE HAVING OFFER ACCEPTANCE GAME WITH TERMINATION LIMIT," Ser. No. 10/971,980.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an improved offer and acceptance bonus scheme.

BACKGROUND OF THE INVENTION

Gaming devices, such as slot machines, having primary and secondary or bonus games or schemes are well known.

One well known bonus game provides a player with a series of award offers consisting of credits or dollars. The player may either accept each award offer or reject each award offer; however, the player must accept the final award offer. If the player accepts an award offer, the player keeps the award offered. If the player rejects the award offer, the gaming device provides another award offer to the player except if the award offer is the final award offer. The award offers are randomly determined from a series of award offers of differing values. As illustrated in FIG. 3, the potential award offers 52 are displayed to the player, each award offer made by the game is displayed in an offer display 54, the number of offers remaining are displayed in an offer remaining display 56, and accept and reject buttons 58 and 60, respectively, enable the user to accept or reject the offers.

Several different embodiments of this type of bonus scheme for a gaming device have been implemented in gaming machines of various types. While this type of gaming device has achieved significant popularity in the gaming industry, after playing the game repeatedly, players may lose interest in the game. Accordingly, there is a need for new gaming devices related to this type of offer and acceptance bonus scheme.

SUMMARY OF THE INVENTION

The present invention provides a gaming device having an improved offer and acceptance bonus scheme. In one embodiment of the improved offer and acceptance bonus scheme of the present invention, the gaming device provides the player an opportunity to determine the number of offers the player may obtain during the bonus round. In particular, this embodiment provides the player with a plurality of masked selections or symbols. The player selects one of the symbols and the gaming device reveals the number of offers associated with the selected symbol. The player obtains the revealed number of offers for use in the offer and acceptance bonus scheme as described above. The gaming device also reveals the number of offers associated with the non-selected symbols. One preferred embodiment includes three symbols and a different number of offers (i.e., three, four and five) associated with the symbols. It should be appreciated that the number of offers associated with each symbol may be randomly determined. The specific number of offers associated with each symbol is randomly determined for each round of the bonus scheme.

In an alternative embodiment of the improved offer and acceptance bonus scheme of the present invention, after the gaming device selects (and displays) one of the possible award offers to the player (such as the one hundred offer 52*a* illustrated in FIG. 3), the gaming device prevents that offer from being made to the player again. In other words, the gaming device removes, eliminates or nullifies a previously offered award from the random determination subsequently made for additional award offers.

It should be appreciated that both of the embodiments of the improved acceptance and offer bonus scheme of the present invention can be simultaneously implemented in a single bonus round or each implemented individually in different bonus rounds. The determination of when to implement such alternative embodiments could also be randomly determined.

It is therefore an object of the present of the present invention to provide a gaming device having an improved offer and acceptance bonus scheme.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
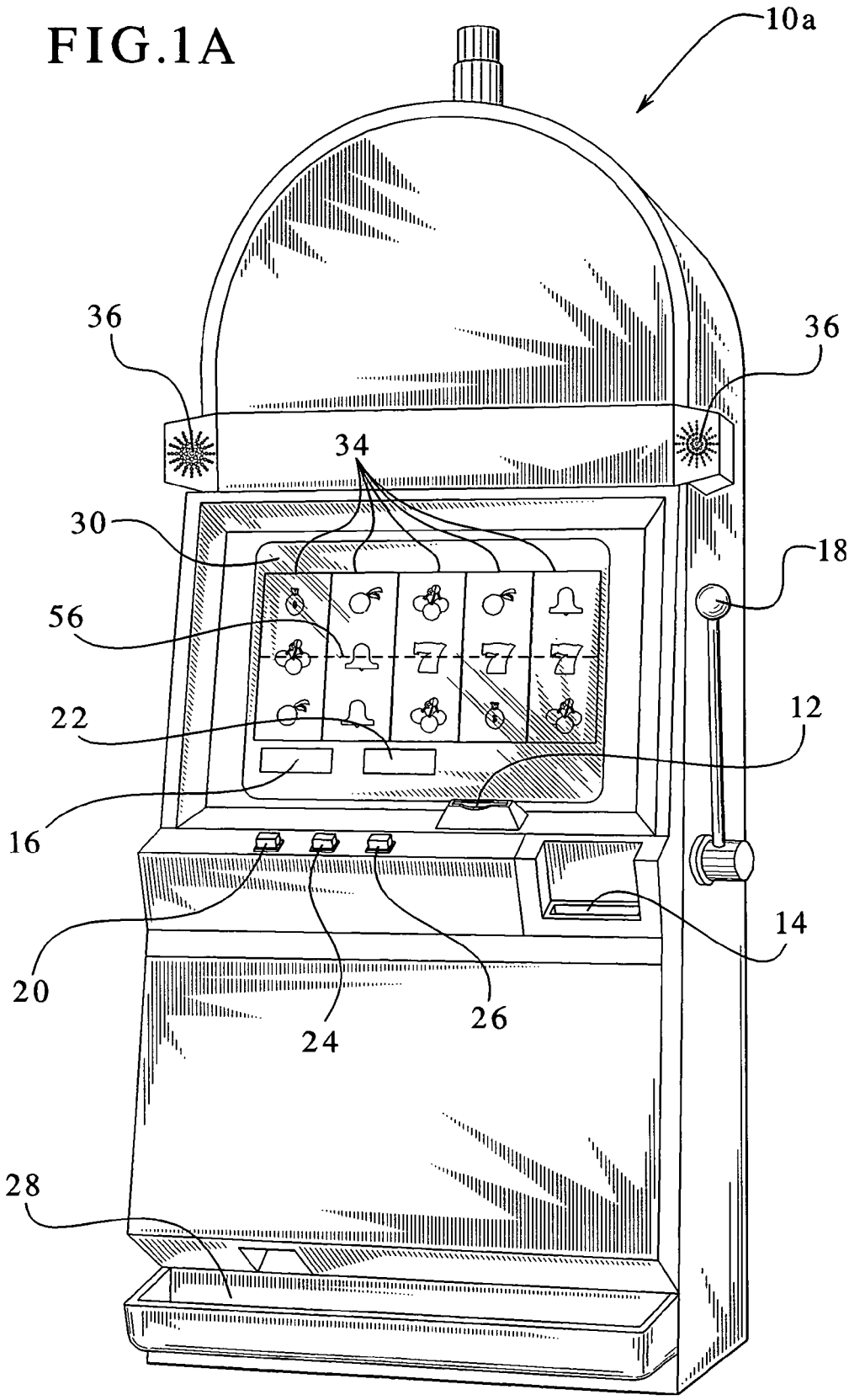
FIGS. 1A and 1B are perspective views of alternative embodiments of the gaming device of the present invention.
Figure 1B:
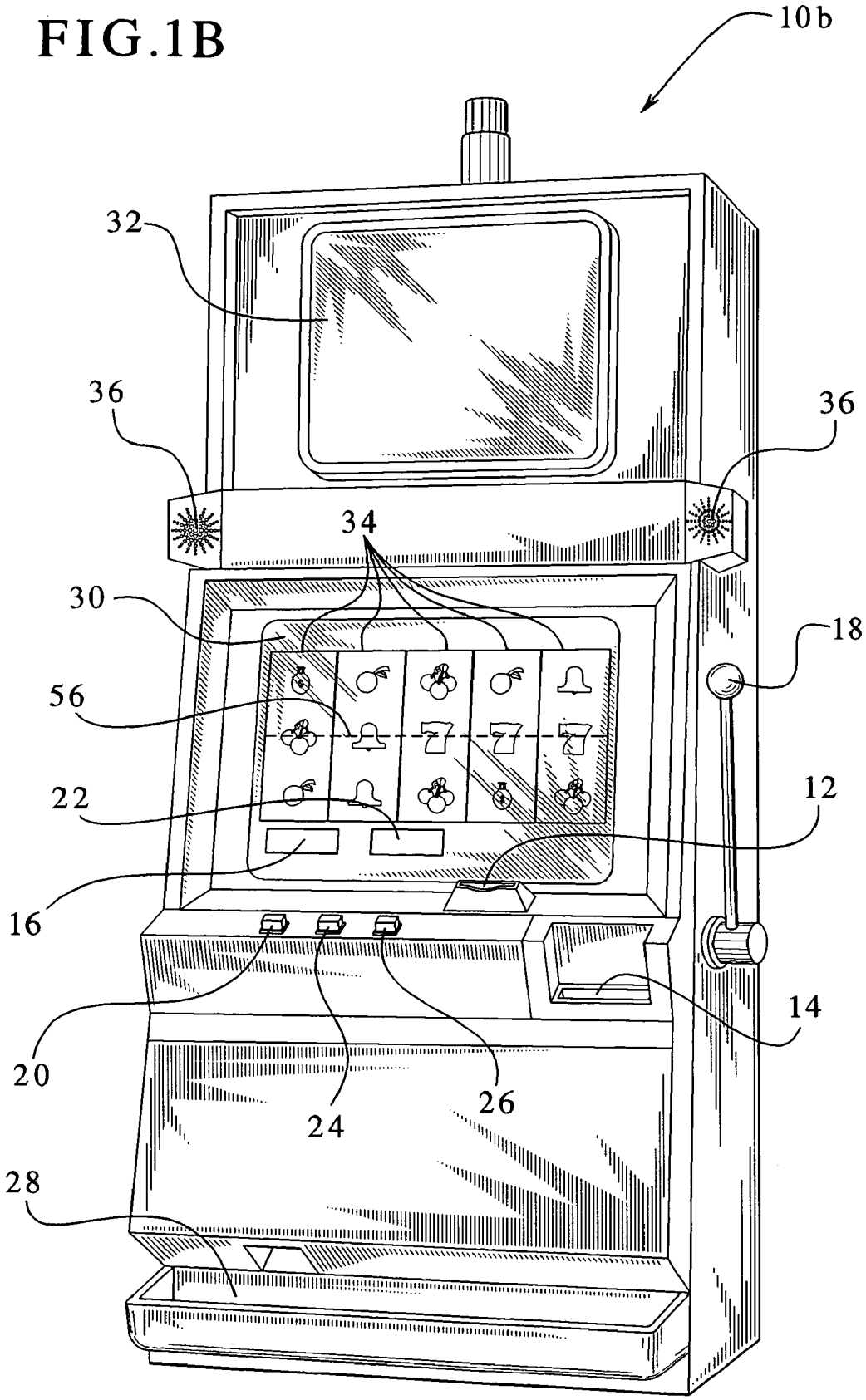

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
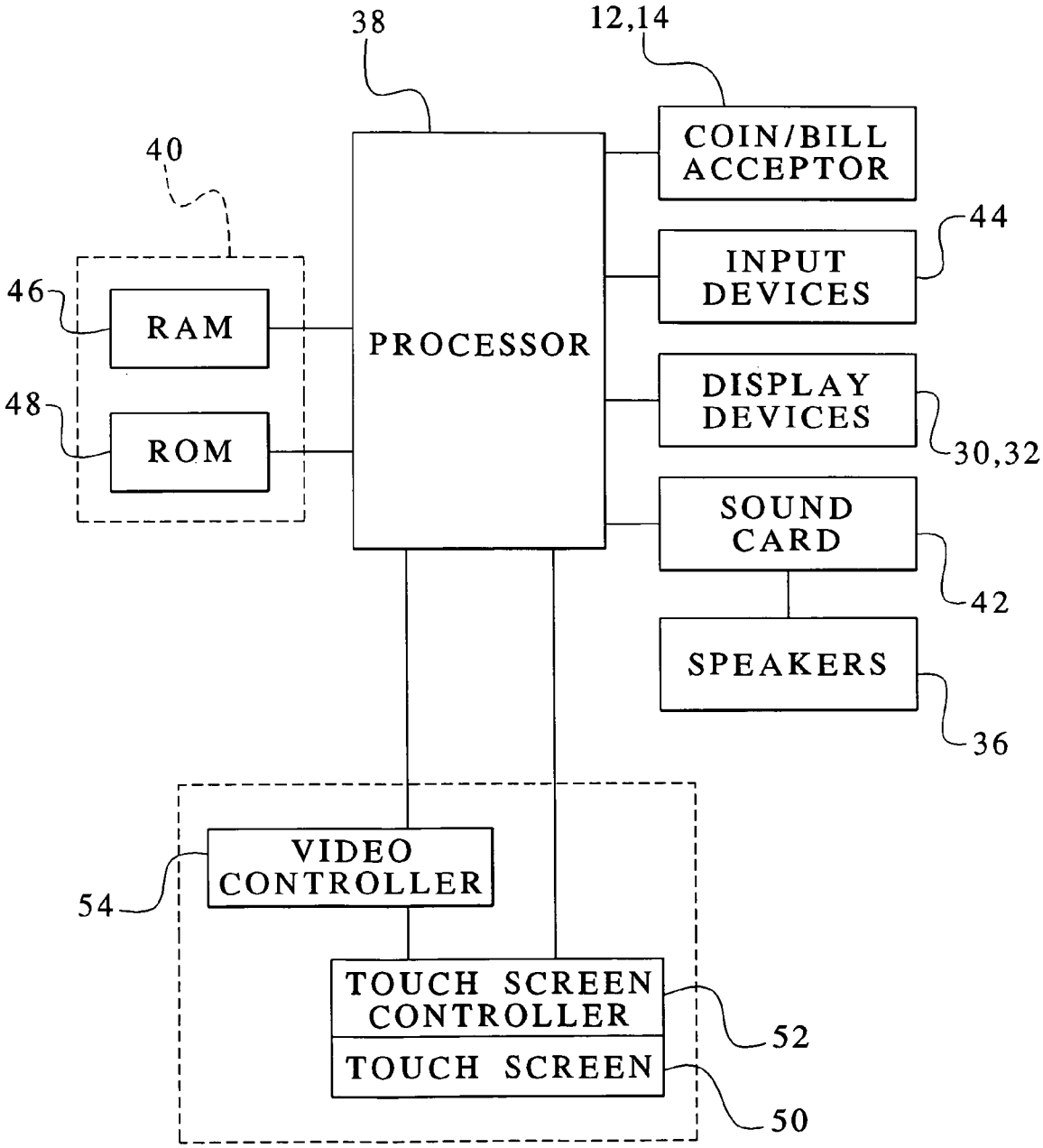
FIG. 2 is a schematic block diagram of the electronic configuration of one embodiment of the gaming device of the present invention.
Figure 3:
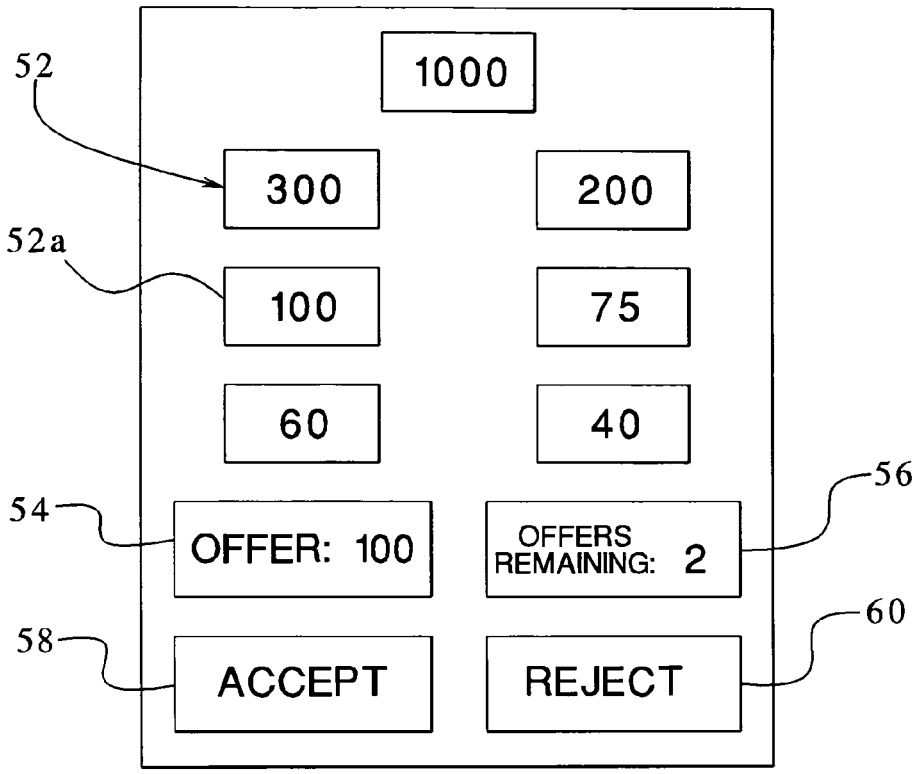
FIG.3 (PRIOR ART)
FIG. 3 is a front elevational view of a prior art offer and acceptance bonus scheme.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Improved Bonus Scheme

Figure 4A:
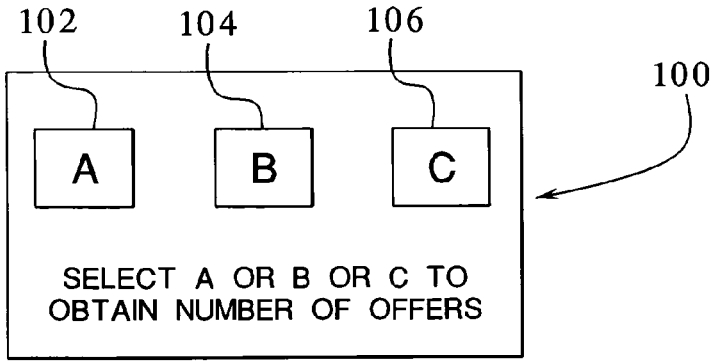
FIG. 4A is a front elevation view of a number of offers determination screen of one embodiment of the improved offer and acceptance bonus scheme of the present invention illustrating a plurality of selections which the player can select to obtain a number of offers.
Figure 4B:
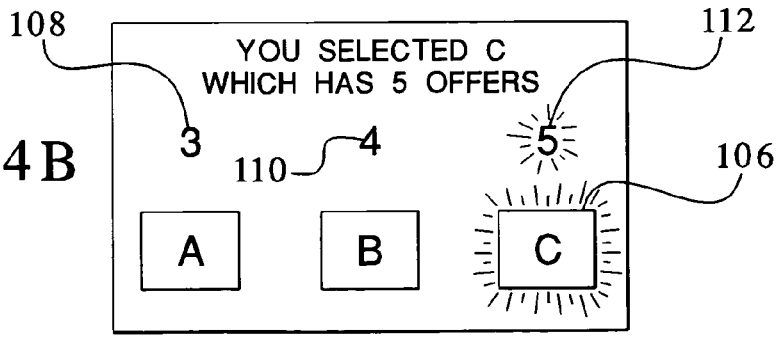
FIG. 4B is a front elevation view of a number of offers determination screen of one embodiment of the improved offer and acceptance bonus scheme of the present invention illustrating the one selection chosen by the player and the number of offers associated with said selection and the other selections.

Referring now to FIGS. 4A and 4B, one embodiment of the improved offer and acceptance bonus scheme of the present invention provides a screen or display 100 (which is preferably a touch screen) which enables the player to make a selection to obtain the number of offers the player may use in connection with an offer and acceptance bonus scheme. The game preferably provides a plurality of selections which the player may select from. For example, in one embodiment, there are three selections 102, 104 and 106 labeled A, B and C, respectfully. The player chooses selection A, selection B or selection C to obtain a number of offers. A predetermined or randomly determined number of offers is associated with each selection 102, 104 and 106. After the player makes a selection as indicated by the highlighted selection 106 in FIG. 4A, the gaming device reveals the number of offers 108, 110 and 112, respectively, associated with each selection. In FIG. 4A, the player selected selection C which had five offers (i.e., the maximum number of offers) associated therewith. If the player would have chosen selection A, the player would have received three offers and if the player had selected selection B, the player would have received four offers. It should be appreciated that each such offer is an opportunity for the player to obtain an award offer and that the player does not have to use each offer. Appropriate messages such as "SELECT A OR B OR C TO OBTAIN NUMBER OF OFFERS" and "YOU SELECTED C WHICH HAS 5 OFFERS" are preferably provided to the player visually, or through suitable audio or audiovisual displays. Although not shown, the display could inform the player of the number of possible offers the player may obtain.

Figure 5A:
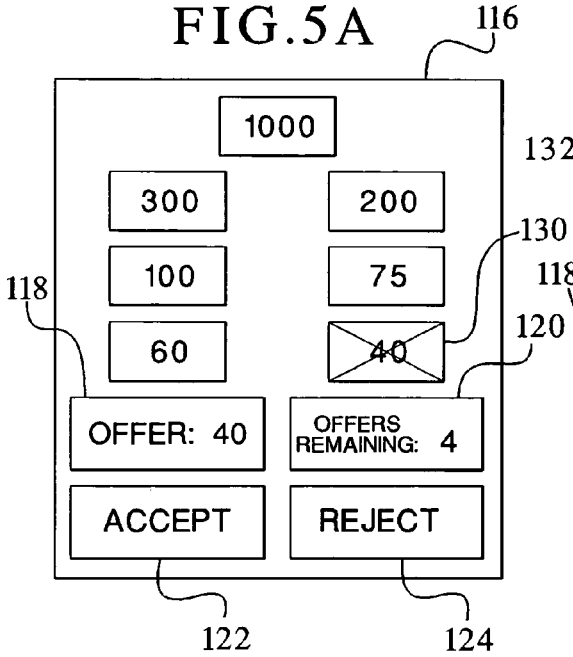
FIGS. 5A, 5B, 5C and 5D are front elevation views of an offer display of an alternative embodiment of the improved offer and acceptance bonus scheme of the present invention graphically illustrating the removal of the award offers from the potential award offers.

As further illustrated in FIG. 5A, the gaming device provides the player with an offer and acceptance display 116 (which is preferably a touch screen) which provides the player with the first award offer in the offer display 118 and the number of offers remaining in the offers remaining display 120. In this case, the first award offer is forty and the number of remaining offers is four, for a total of five offers. The player may accept this award offer or reject the award offer and continue to use each of the remaining offers prior to the time the player accepts an award offer or the last offer is made to the player. Once the player accepts an award offer, the gaming device provides the player with the award and the player cannot obtain any more award offers. If the player rejects all of the offers (prior to the last offer), the gaming device provides the player with the last offer (i.e., the player cannot reject the last offer).

Referring now to FIGS. 5A, 5B, 5C and 5D, in a further alternative embodiment of the present invention, the player is provided with a forty award offer 130, and has four offers remaining. In this embodiment, the forty award offer 130 is graphically illustrated with an "X" through it. This is a graphical illustration that if the player chooses to reject the award offer and have the gaming device select a further award offer, the gaming device will not reselect the forty award offer and will randomly determine from the other award offers which award offer the gaming device will make to the player. It should be appreciated that the game of the present invention could communicate the removed award offer to the player in any suitable manner.

Figure 5B:
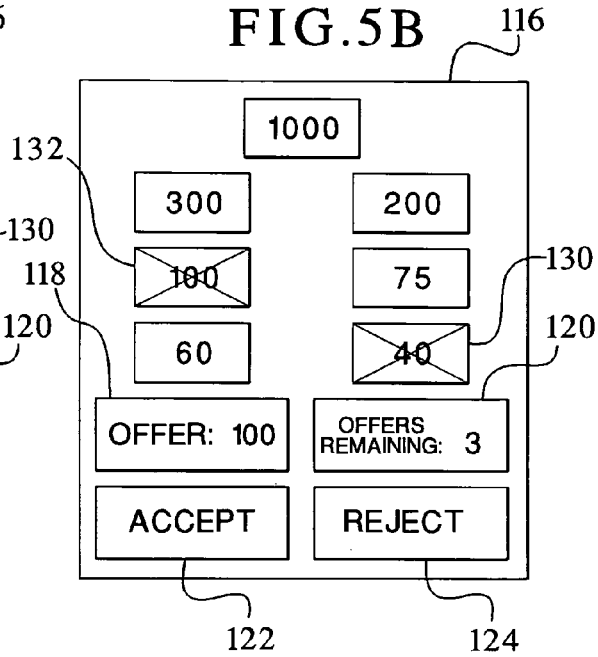

Assuming the player rejects the forty award offer using the reject button or indicator 124, the forty offer is no longer available to be offered to the player. FIG. 5B illustrates that the next award offer made by the gaming device is one hundred and the player has three offers remaining. In addition to the forty award offer 130 being eliminated, the one hundred award offer 132 is eliminated as graphically illustrated by the "X" in FIG. 5B.

Figure 5C:
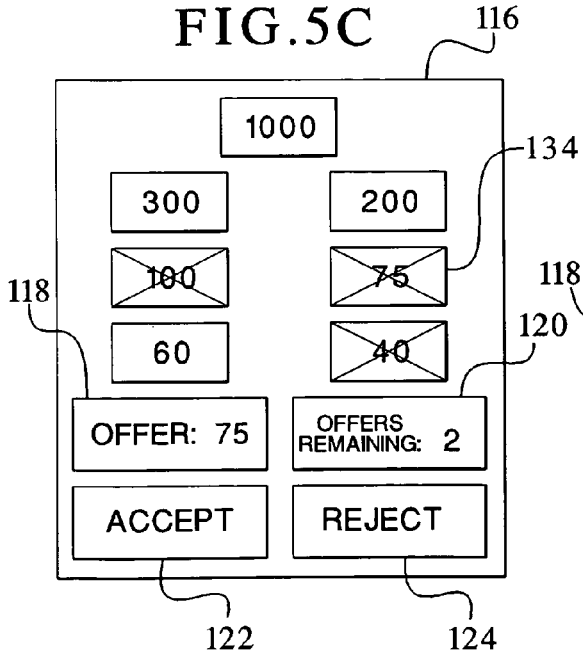

Assuming the player also rejects this award offer, FIG. 5C illustrates that the next award offer made by the gaming device is seventy-five and the player has two offers remaining. Again, in addition to the one hundred award offer and the forty award offer being removed or eliminated, now the seventy-five award offer 134 also has an "X" through it to graphically illustrate the removal or elimination of the seventy-five award offer 134. Again, it should be appreciated that the elimination or removal of the offer may be displayed or communicated in any suitable manner to the player. It should be appreciated that the probability of obtaining some or all of the other award offers preferably increases when an award offer is removed or that the probabilities of obtaining each remaining award offer could be re-weighted.

Figure 5D:
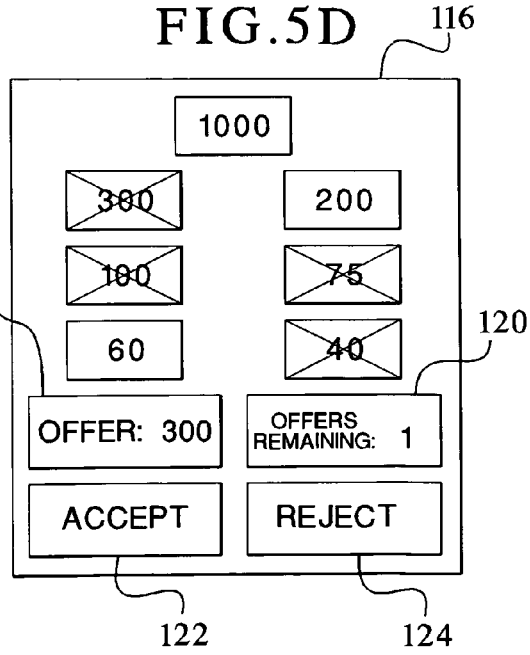

Assuming the player also rejects this award offer, in FIG. 5D the award offer is three hundred and the player has one offer remaining. More likely than not, the player will opt to accept this award offer by using the accept button or indicator 122. The display 116 graphically shows that the three hundred award offer is also now eliminated and if the player chooses to reject the award offer, the gaming device will randomly choose or select between the remaining award offer from the 1,000 award offer, the 200 award offer and the 60 award offer to provide the player with a new and final or last offer. Accordingly, the gaming device provides the player with a decreased number of potential award offers after each rejection of an award offer. It should be appreciated that at any time, such as on the last award offer, the gaming scheme could add back one or more of the removed award offers. It should also be appreciated that after an award offer, the game could randomly determine which, if any, award offer to eliminate or remove instead of removing the offered award offer.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operable under control of a processor, said gaming device comprising:

a game controlled by the processor;

a plurality of award offers in the game; and a display device operable to display the game;

wherein the processor is operable with the display device to control a play of the game by:

(a) selecting one of the award offers from said plurality of award offers and displaying said award offer;

(b) enabling a player to accept or reject the selected award offer;

(c) if the player accepts the selected award offer or the selected award offer is a final award offer, providing the selected award offer to the player; and (d) if the player rejects the selected award offer and the selected offer is not the final award offer:

(i) determining whether to eliminate the selected award offer, (ii) if the determination is to eliminate the selected award offer, eliminating the selected award offer from the plurality of award offers which may be subsequently selected, (iii) selecting one of the non-eliminated award offers and displaying said award offer; and (vi) repeating (b) to (d) at least once.

2. The gaming device of claim 1, wherein the processor is operable to control the play of the game by adding at least one of the previously eliminated award offers back into the plurality of award offers which may be subsequently selected.

3. The gaming device of claim 1, wherein the processor is operable to control the play of the game by determining a maximum number of award offers which may be selected.

4. The gaming device of claim 1, wherein the processor is operable to control the play of the game by determining to eliminate at least one of the selected award offers.

5. The gaming device of claim 1, wherein the processor is operable to control the play of the game by determining to eliminate a plurality of the selected award offers.

6. The gaming device of claim 1, wherein the processor is operable to control the play of the game by determining to eliminate each of the selected award offers.

7. A gaming device operable under control of a processor, said gaming device comprising:

a game controlled by the processor;

a plurality of award offers in the game; and a display device operable to display the game;

wherein the processor is operable with the display device to control a play of the game by:

(a) selecting one of the award offers from said plurality of award offers and displaying said award offer;

(b) enabling a player to accept or reject the selected award offer;

(c) if the player accepts the selected award offer or the selected award offer is a final award offer, providing the selected award offer to the player; and (d) if the player rejects the selected award offer and the selected offer is not the final award offer:

(i) eliminating one of the award offers from the plurality of award offers which may be subsequently selected, (ii) selecting one of the non-eliminated award offers and displaying said award offer; and (iii) repeating (b) to (d) at least once.

8. The gaming device of claim 7, wherein the processor is operable to control the play of the game by adding at least one of the previously eliminated award offers back into the plurality of award offers which may be subsequently selected.

9. The gaming device of claim 7, wherein the processor is operable to control the play of the game by determining a maximum number of award offers which may be selected.

10. The gaming device of claim 7, wherein the processor is operable to control the play of the game by randomly determining which of the award offers to eliminate.

11. A gaming device operable under control of a processor, said gaming device comprising:

a game controlled by the processor, said game operable upon a wager by a player;

a plurality of award offers in said game, wherein each of said award offers is initially associated with a probability of being selected; and a display device operable to display the game;

wherein the processor is operable with the display device to control a play of the game by:

(a) selecting one of the award offers from the plurality of award offers, wherein said selection is based on the probabilities associated with the award offers;

(b) displaying the selected award offer;

(c) enabling the player to accept or reject the selected award offer;

(d) if the player accepts the selected award offer or the selected award offer is a final award offer, providing the selected award offer to the player; and (e) if the player rejects the selected award offer and the selected award offer is not the final award offer:

(i) modifying the probabilities of being selected associated with a plurality of the award offers, (ii) selecting another one of the award offers, wherein said selection is based on the modified probabilities associated with the award offers; and (iii) repeating (b) to (e) at least once.

12. The gaming device of claim 11, wherein the processor is operable to control the play of the game by modifying the probabilities of being selected associated with each of the award offers.

13. The gaming device of claim 11, wherein the processor is operable to control the play of the game by modifying the probability associated with the selected award offer to a zero probability.

14. The gaming device of claim 11, wherein the processor is operable to control the play of the game by modifying the probability associated with at least one of the award offers to a zero probability.

15. A gaming device operable under control of a processor, said gaming device comprising:

a game controlled by the processor;

a plurality of awards in the game; and a display device operable to display the game;

wherein the processor is operable with the display device to control a play of the game by:

(a) selecting at least one of the awards;

(b) forming an offer based on the selected awards;

(c) enabling a player to accept or reject the formed offer;

(d) if the player accepts the formed offer or the formed offer is a final offer, providing the formed offer to the player; and (e) if the player rejects the formed offer and the formed offer is not the final offer:

(i) eliminating at least one of the selected awards from the plurality of awards which may be subsequently selected, (ii) selecting at least one of the non-eliminated awards; and (iii) repeating (b) to (e) at least once.

16. The gaming device of claim 15, wherein the processor is operable to control the play of the game by adding at least one of the previously eliminated awards back into the plurality of awards which may be subsequently selected.

17. The gaming device of claim 15, wherein the processor is operable to control the play of the game by determining a maximum number of offers which may be formed.

18. The gaming device of claim 15, wherein the processor is operable to control the play of the game by selecting a plurality of the awards to form at least one of the offers.

19. A method of operating a gaming device, said method comprising:

(a) selecting one of a plurality of award offers and displaying said selected award offer;

(b) enabling a player to accept or reject the selected award offer;

(c) if the player accepts the selected award offer or the selected award offer is a final award offer, providing the selected award offer to the player; and (d) if the player rejects the selected award offer and the selected award offer is not the final award offer:

(i) determining whether to eliminate the selected award offer, (ii) if the determination is to eliminate the selected award offer, eliminating the selected award offer from the plurality of award offers which may be subsequently selected;

(iii) selecting one of the non-eliminated award offers and displaying said selected award offer; and (iv) repeating (b) to (d) at least once.

20. The method of claim 19, which includes adding at least one of the previously eliminated award offers back into the plurality of award offers which may be subsequently selected.

21. The method of claim 19, which includes determining a maximum number of award offers which may be selected.

22. The method of claim 19, which includes determining to eliminate at least one of the selected award offers.

23. The method of claim 19, which includes determining to eliminate a plurality of the selected award offers.

24. The method of claim 19, which includes determining to eliminate each of the selected award offers.

25. The method of claim 19, which is provided through a data network.

26. The method of claim 25, wherein the data network is an internet.

27. A method of operating a gaming device, said method comprising:

(a) selecting one of a plurality of award offers and displaying said selected award offer;

(b) enabling a player to accept or reject the selected award offer;

(c) if the player accepts the selected award offer or the selected award offer is a final award offer, providing the selected award offer to the player; and (d) if the player rejects the selected award offer and the selected award offer is not the final award offer:

(i) eliminating one of the award offers from the plurality of award offers which may be subsequently selected, (ii) selecting one of the non-eliminated award offers and displaying said selected award offer; and (iii) repeating (b) to (d) at least once.

28. The method of claim 27, which includes adding at least one of the previously eliminated award offers back into the plurality of award offers which may be subsequently selected.

29. The method of claim 27, which includes determining a maximum number of award offers which may be selected.

30. The method of claim 27, which includes randomly determining which of the award offers to eliminate.

31. The method of claim 27, which is provided through a data network.

32. The method of claim 31, wherein the data network is an internet.

33. A method of operating a gaming device, said method comprising:

(a) selecting one of a plurality of award offers, wherein each of said award offers is initially associated with a probability of being selected and said selection is based on the probabilities associated with the award offers;

(b) displaying to the player the selected award offer and displaying said selected award offer;

(c) enabling the player to accept or reject the selected award offer;

(d) if the player accepts the selected award offer or the selected award offer is a final award offer, providing the selected award offer to the player; and (e) if the player rejects the selected award offer and the selected award offer is not the final award offer:

(i) modifying the probabilities of being selected associated with a plurality of the award offers, (ii) selecting another one of the award offers and displaying said selected award offer, wherein said selection is based on the modified probabilities associated with the award offers; and (iii) repeating (b) to (e) at least once.

34. The method of claim 33, which includes modifying the probabilities of being selected associated with each of the award offers.

35. The method of claim 33, which includes modifying the probability associated with the selected award offer to a zero probability.

36. The method of claim 33, which includes modifying the probability associated with at least one of the award offers to a zero probability.

37. The method of claim 33, which is provided through a data network.

38. The method of claim 37, wherein the data network is an internet.

39. A method of operating a gaming device, said method comprising:

(a) selecting at least one of awards;

(b) forming an offer based on the selected awards;

(c) enabling a player to accept or reject the formed offer;

(d) if the player accepts the formed offer or the formed offer is a final offer, providing the formed offer to the player; and (e) if the player rejects the formed offer and the formed offer is not the final offer:

(i) eliminating at least one of the selected awards from a plurality of awards which may be subsequently selected, (ii) selecting at least one of the non-eliminated awards; and (iii) repeating (b) to (e) at least once.

40. The method of claim 39, which includes adding at least one of the previously eliminated awards back into the plurality of awards which may be subsequently selected.

41. The method of claim 39, which includes determining a maximum number of offers which may be formed.

42. The method of claim 39, which includes selecting a plurality of the awards to form at least one of the offers.

43. The method of claim 39, which is provided through a data network.

44. The method of claim 43, wherein the data network is an internet.

* * * * *

UNITED STATES PATENT AND TRADEMARK OFFICE

CERTIFICATE OF CORRECTION

PATENT NO. : 7,235,010 B2
APPLICATION NO. : 11/112566
DATED : June 26, 2007
INVENTOR(S) : Anthony J. Baerlocher It is certified that error appears in the above-identified patent and that said Letters Patent is hereby corrected as shown below:

IN THE SPECIFICATION:

In Column 2, Line 64, change “of the present of the present” to --of the present--.

IN THE CLAIMS:

In Claim 39, column 11, line 10, change “selecting at least one of awards;” to --selecting at least one of the awards;--.

Signed and Sealed this

Eighteenth Day of March, 2008

JON W. DUDAS
*Director of the United States Patent and Trademark Office*